US008697970B2

(12) United States Patent
Harrison et al.

(10) Patent No.: US 8,697,970 B2
(45) Date of Patent: Apr. 15, 2014

(54) CYMBAL MOUNTING ASSEMBLY

(76) Inventors: Gavin Harrison, Bushey-herts (GB); David Hollingbery, Palatine, IL (US)

( * ) Notice: Subject to any disclaimer, the term of this patent is extended or adjusted under 35 U.S.C. 154(b) by 73 days.

(21) Appl. No.: 13/143,951

(22) PCT Filed: Jan. 12, 2010

(86) PCT No.: PCT/US2010/020754
§ 371 (c)(1),
(2), (4) Date: Jul. 11, 2011

(87) PCT Pub. No.: WO2010/081143
PCT Pub. Date: Jul. 15, 2010

(65) Prior Publication Data

US 2011/0265632 A1 Nov. 3, 2011

Related U.S. Application Data

(60) Provisional application No. 61/143,838, filed on Jan. 12, 2009, provisional application No. 61/164,863, filed on Mar. 30, 2009.

(51) Int. Cl.
*G10D 13/08* (2006.01)

(52) U.S. Cl.
USPC ..... 84/402

(58) Field of Classification Search
USPC ..... 84/402–410
See application file for complete search history.

(56) References Cited

U.S. PATENT DOCUMENTS

| | | | | |
|---|---|---|---|---|
| 2,670,229 | A | | 3/1953 | Gore |
| 4,101,704 | A | | 7/1978 | Hiles |
| 4,216,695 | A | | 8/1980 | Hoshino |
| 4,346,205 | A | | 8/1982 | Hiles |
| 4,476,258 | A | | 10/1984 | Hiles |
| 4,526,083 | A | | 7/1985 | LeMert |
| D287,902 | S | | 1/1987 | Forsyth |
| 4,683,709 | A | | 8/1987 | Vasko et al. |
| 4,777,739 | A | | 10/1988 | Hamilton et al. |
| 4,808,469 | A | | 2/1989 | Hiles |
| 4,960,028 | A | * | 10/1990 | Ramirez ..... 84/421 |
| 5,108,092 | A | | 4/1992 | Hurst |
| 5,131,619 | A | | 7/1992 | Daugherty |
| 5,482,235 | A | | 1/1996 | Atsumi |
| 5,649,467 | A | | 7/1997 | Sangret |
| 5,722,117 | A | | 3/1998 | Nielsen |
| 5,726,395 | A | | 3/1998 | Anagnos |
| 5,731,554 | A | | 3/1998 | Anagnos |
| 5,787,610 | A | | 8/1998 | Brooks |
| 5,820,522 | A | | 10/1998 | Smallwood et al. |
| 5,929,354 | A | * | 7/1999 | Davis ..... 84/411 P |
| 5,949,033 | A | | 9/1999 | Anagnos |
| 5,964,046 | A | | 10/1999 | Brooks |
| 6,041,524 | A | | 3/2000 | Brooks |
| 6,093,468 | A | | 7/2000 | Toms et al. |
| 6,096,254 | A | | 8/2000 | Nielsen |
| 6,252,159 | B1 | | 6/2001 | Anagnos |

(Continued)

FOREIGN PATENT DOCUMENTS

| | | |
|---|---|---|
| JP | 2007024280 A | 2/2007 |
| WO | PCT/US2010/020754 | 1/2010 |

*Primary Examiner* — Kimberly Lockett
(74) *Attorney, Agent, or Firm* — Patrick J. Halloran

(57) ABSTRACT

This disclosure relates to cymbal mounting assemblies, and provides viscoelastic washers for mounting a musical cymbal onto a conventional cymbal stand to preserve the integrity of the cymbal.

19 Claims, 5 Drawing Sheets a) wing nut; b) felt washer; c) nylon or rubber sleeve; d) cymbal; e) felt washer; f) metal washer; g) tilter rod shaft (threaded); and, h) tilter

(56) References Cited

U.S. PATENT DOCUMENTS

| | | | | |
|---|---|---|---|---|
| 6,305,115 | B1 | 10/2001 | Cook | |
| 6,424,887 | B1 | 7/2002 | Allaei | |
| 6,751,092 | B1 | 6/2004 | Ohnishi et al. | |
| 6,830,140 | B2 * | 12/2004 | Zink et al. | 192/48.9 |
| 6,854,198 | B2 | 2/2005 | Brooks | |
| 6,873,524 | B2 | 3/2005 | Kaczeus et al. | |
| 6,888,698 | B1 | 5/2005 | Berding et al. | |
| 6,940,006 | B2 | 9/2005 | Takegawa | |
| 7,028,419 | B2 | 4/2006 | Brooks | |
| 7,037,240 | B2 | 5/2006 | Pemberton | |
| 7,204,159 | B2 | 4/2007 | Hasegawa | |
| 7,207,899 | B2 | 4/2007 | Imamoto | |
| 7,290,759 | B1 | 11/2007 | Lavrencik | |
| 7,423,211 | B2 | 9/2008 | Hsieh et al. | |
| 7,456,245 | B2 | 11/2008 | Dunham et al. | |
| 2002/0113191 | A1 | 8/2002 | Rolt et al. | |
| 2004/0182222 | A1 | 9/2004 | Demers et al. | |
| 2005/0067458 | A1 | 3/2005 | Swayze et al. | |
| 2006/0123664 | A1 | 6/2006 | Boyd et al. | |
| 2006/0156902 | A1 | 7/2006 | Judd | |
| 2007/0079687 | A1 | 4/2007 | Hsieh | |

* cited by examiner a) wing nut; b) felt washer; c) nylon or rubber sleeve; d) cymbal; e) felt washer; f) metal washer; g) tilter rod shaft (threaded); and, h) tilter a) exposed clutch shaft; b) thumbnut; c) felt washer; d) cymbal; e) felt washer; f) non-slip cap; g) hi-hat rod

A.

1a) one side of washer body; 1b) sleeve; 1c) ribs on one side; 1d) other side of washer body; e) ribs on other side

B.

2a) rim of material 30) inner fastener; 40) outer fasteners; 50, 60) composite washer assemblies; 51, 61) rubber washers; 52, 62) felt washers; 53, 63) optional silica gel washer a) outer fastener (wing nut); b) upper washer; c) viscoelastic washer; d) felt washer; e) base support washer; f) protective sleeve; g) cymbal; h) cymbal stand shaft

CYMBAL MOUNTING ASSEMBLY

RELATED APPLICATIONS

This application claims priority to U.S. Ser. No. 61/143,838 filed Jan. 12, 2009 and U.S. Ser. No. 61/164,863 filed Mar. 30, 2009.

FIELD OF THE DISCLOSURE

This disclosure relates to cymbal mourning assemblies, and provides viscoelastic washers for mounting a musical cymbal onto a conventional cymbal stand to preserve the integrity of the cymbal.

BACKGROUND

Cymbal breakage is a recognized problem in the music industry. Cymbals may break as a result of the contact between the stick and the cymbal, either while the cymbal is stationary or moving while being played. When playing a cymbal using a stick, the force of the impact is converted to motion (the cymbal moves away from the point of contact with the stick), sound (the impact of the stick and the subsequent vibration of the cymbal creates the desirable sound of the instrument), and heat (typically minor and rapidly dissipated through the relatively large surface area of the cymbal). The motion of the cymbal is countered by the braking effect of the cymbals mounting components. In a typical cymbal assembly, the majority of these forces in the system are absorbed by the felt pads, steel washers, plastic sleeve, the cymbal stand and the floor. Current cymbal mounting assemblies are, on occasion, unable to adequately absorb and dissipate the impact force applied to the system away front the cymbal itself. As a result, excessive force is exerted on the cymbal and its mounting arrangement leading to the breakage of the cymbal. Such breakages typically occur at the edge, in the body, and or near the center hole (usually on smaller cymbals). At present, a cymbal is typically affixed to its stand by the following arrangement as shown in, for example, FIGS. 1 and 2. A steel base washer sits upon a step in the upper portion of the stand. A plastic sleeve slides over the shaft to make a slip fit to the upper portion of the stand. The plastic sleeve prevents metal to metal contact between the cymbal and stand. This plastic sits upon the base steel washer. A felt pad with a central locating hole sits upon the base washer with the plastic sleeve slightly protruding front its inner diameter. The cymbal sits upon this lower felt pad with the plastic sleeve protecting its inner diameter. Another felt pad sits on the top of the cymbal followed by an additional steel washer. The arrangement is secured in place by a nut, typically a wing nut. This conventional means of mounting the cymbal on the cymbal stand has proven generally unsatisfactory when cymbals are hit very hard for maximum sound output. While providing some protection of the cymbal, the felt washers are unable to adequately absorb and dissipate the forces in the system and cracks or ruptures often appear in the body of the cymbal adjacent to its central hole resulting in failure of the cymbal to produce its intended sounds.

Previous publications demonstrate various methods for improving cymbal mounting assemblies. For example, U.S. Pat. No. 5,482,235 (e.g., FIG. 1) discloses a pair of felt washers consisting of an upper washer and lower washer are fined over a hollow bolt so that the upper cymbal is held between the two washers. U.S. Pat. No. 4,562,083 describes an apparatus consisting of four major components: 1) a machine nut threaded to fit onto the threaded upper end of the cymbal stand; 2) a cylindrical fitting made preferably of cast or molded rubber which is screwed onto the threaded upper end of the cymbal stand to rest firmly against the nut and includes an upwardly projecting threaded shaft; 3) a washer with an annular shoulder sized to fit snugly within the hole of a cymbal and which sits an the upper face of the cylindrical fitting; and, 4) an internally threaded knob adapted to be screwed onto the threaded shaft of the fitting after the cymbal has been placed onto the shouldered washer. Prior to threading the knob onto the threaded shaft of the fitting, it is suggested to optionally first place a flexible washer (e.g., made of rubber or similar resilient material) over the end of the shaft to rest on top of the cymbal. In either event the knob is then hand tightened against the flexible shouldered washer or against the upper surface of the cymbal itself. U.S. Pat. No. 7,394,009 relates to a rubber washer with a center hole and touch areas raised above surrounding areas of rubber washer to minimize cymbal contact and improve cymbal tone. And U.S. Pat. No. 7,423,211 (e.g., FIG. 3) relates to cymbal assemblies including a washer assembly consisting of rubber washer, a felt washer and a silica gel washer.

There is a need in the art for additional further improved cymbal mourning assemblies that protect against cymbal breakage. The cymbal mounting assembly described herein provides many advantages that are typically not provided by conventional cymbal assemblies. For instance, the assembly provides superior protection against cymbal breakage by incorporating viscoelastic washers into cymbal assemblies. As such, the user may simply replace conventional washers (e.g., felt, rubber) with those described herein instead of utilizing an entirely new arrangement (e.g., internally threaded shafts). There is also no significant change to standard assemblies that would cause the user to modify his or her playing style by increasing the height of the cymbal). Other advantages of the assemblies described herein will be revealed by the description provided below.

SUMMARY OF THE DISCLOSURE

Described herein are viscoelastic washers for use in cymbal assemblies to decrease or eliminate cymbal breakage during use. In one embodiment, a cymbal assembly for securing a cymbal to cymbal stand is provided, the cymbal assembly comprising at least one washer made from a viscoelastic material (e.g., a viscoelastic washer) is provided. In preferred embodiments, the viscoelastic material is that marketed under the tradename Sorbothane®. In some embodiments, the cymbal assembly comprises a cymbal stand shaft, a sleeve comprised of shock absorbing material secured to the cymbal stand shaft, one or more substantially solid washers for supporting the at least one viscoelastic washer, and or one or more flexible washers in contact with the at least one viscoelastic washer. In some embodiments, the shock absorbing material is selected from the group consisting of plastic, rubber, paper, gel, cloth and felt. In some embodiments, the flexible washer comprises a flexible material selected from the group consisting of plastic, rubber, paper, gel, cloth, and felt. The cymbal assembly may also comprise a device for fastening the components of the cymbal assembly to one another. In certain embodiments, the viscoelastic washer comprises an outer surface comprising a non-stick coating such as, for example, a material comprising polyurethane, polytetrafluoroethylene, Teflon®, powder, or talcum powder. Viscoelastic washers comprising non-viscoelastic materials are also disclosed. Other aspects of this disclosure will be evident from the description provided below.

DETAILED DESCRIPTION

Figure 1:
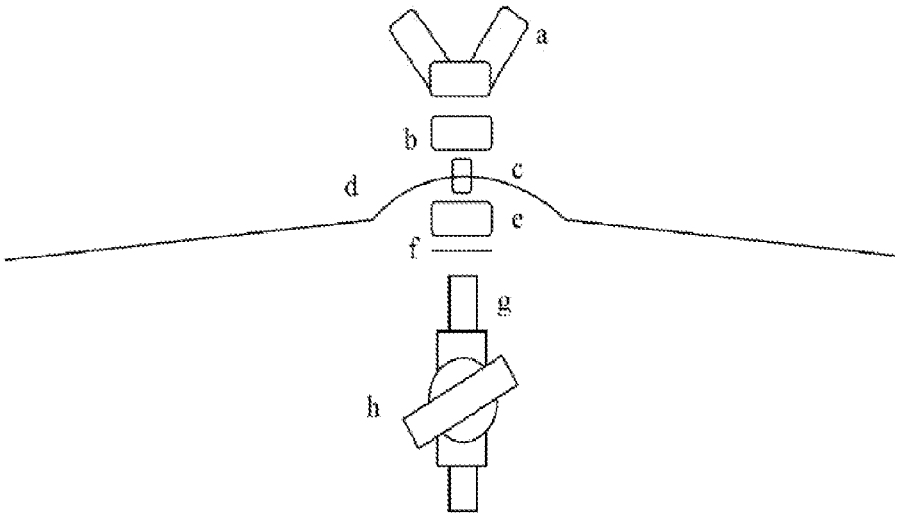
FIG. 1 illustrates a currently available cymbal mounting assembly.
Figure 2:
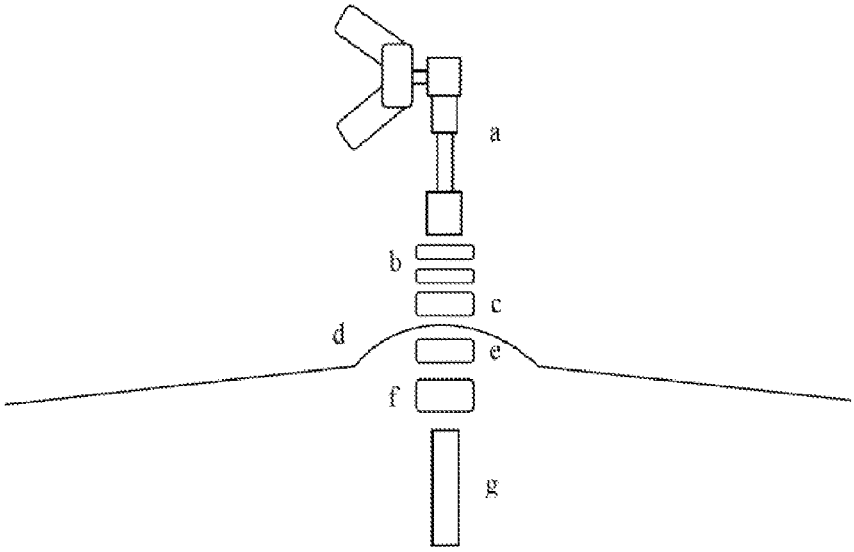
FIG. 2 illustrates another currently available cymbal mounting assembly.
Figure 3:
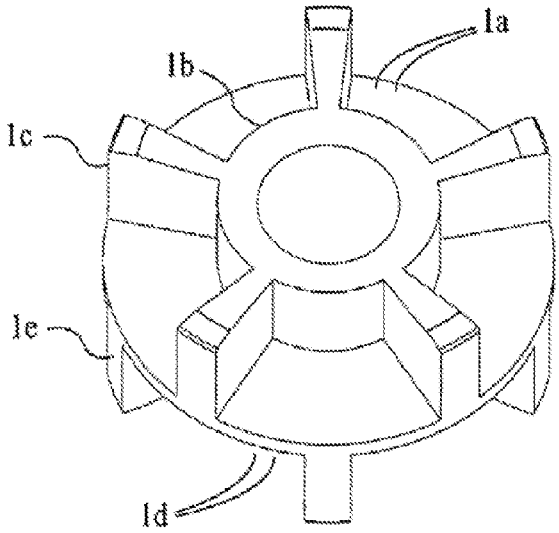
FIGS. 3A and B illustrate the modified washer cymbal mounting assembly illustrated in U.S. Pat. No. 7,394,009.
Figure 3:
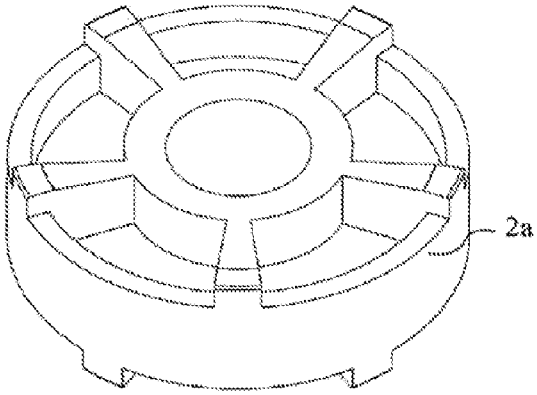
Figure 4:
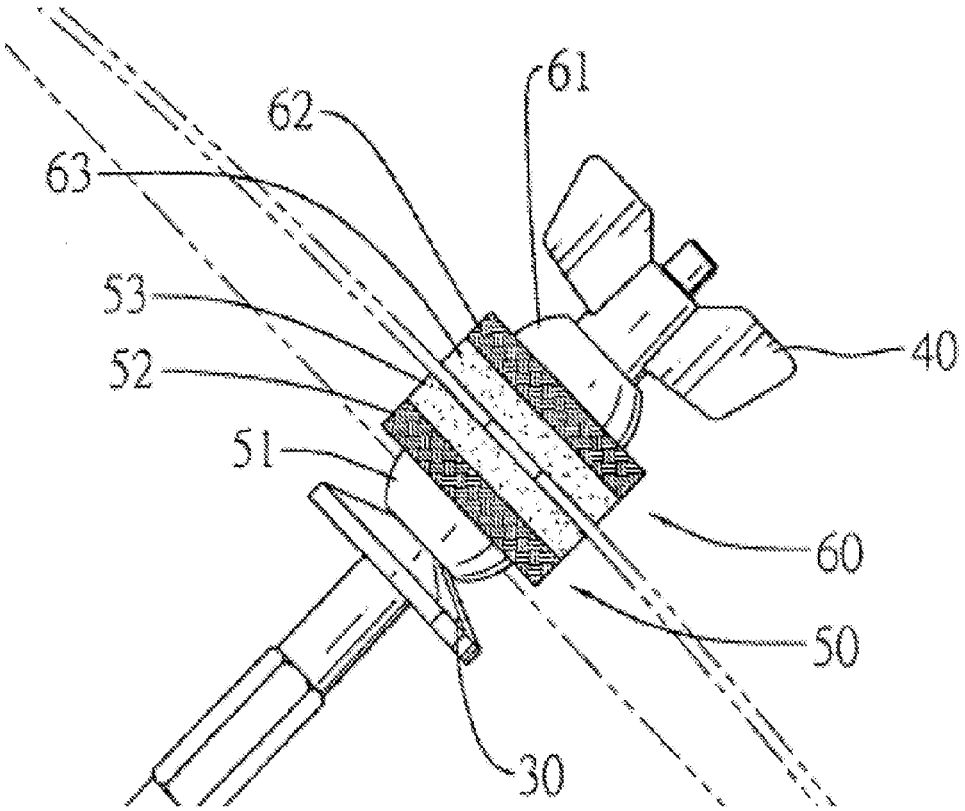
FIG. 4 illustrates a cymbal mounting assembly shown in U.S. Pat. No. 7,423,211.

When a cymbal is struck by a drumstick, the force of the impact causes the cymbal to accelerate away from the stick. As shown herein, it has been found that the properties of viscoelastic materials serve to apply a gradual braking effect to reduce the velocity of the cymbal. This reduction in velocity greatly reduces the impact force of the cymbal mounting assembly (e.g., steel washers, plastic sleeve, stand shaft and wing nut) upon the cymbal. This reduction in velocity also leads to a reduction in the velocity at which the cymbal returns to its original position. In the event that the cymbal is struck again, the reduced return velocity lowers the collision impact force between the cymbal and the stick decreasing the likelihood of breakage. As described herein, the use of "washers" made of viscoelastic materials (e.g., Sorbothane®) in cymbal mounting assemblies may be utilized to provide surprisingly superior protection against breakage when compared to currently available cymbal mounting assemblies. The viscoelastic washers are typically of any convenient shape, but preferably substantially round, and include a centrally-oriented orifice (e.g., a hole) allowing the piece to fit over a conventional cymbal stand. For instance, the viscoelastic washer may be in a circular shape (typically having a diameter of about 20, 30, 35, 40, 45, or 50 mm) with a centrally-positioned circular orifice (typically having a diameter of about 5 to 10 mm) placed therein using standard molding techniques. In certain embodiments, the diameter of the viscoelastic washer is about 35 mm and the diameter of the centrally-positioned orifice is about 5 mm. By "Centrally positioned" means that the orifice is positioned at about the center of the viscoelastic washer (e.g., in a 35 mm diameter viscoelastic washer, the outside edge and center of the orifice will typically be about 14-15 mm and 18 mm, respectively, from the outside edge of the viscoelastic washer). Other shapes and sizes could be used as required by the user, as would be understood by one of skill in the art.

Viscoelasticity is the property of materials that exhibit both viscous and elastic characteristics when undergoing deformation. "Viscous" materials, like honey, resist shear flow and strain linearly with time when a stress is applied. "Elastic" materials strain instantaneously when stretched and just as quickly return to their original state on the stress is removed. "Viscoelastic" materials have elements of both of these properties. Whereas elasticity is usually the result of bond stretching along crystallographic planes in an ordered solid, viscoelasticity is the result of the diffusion of atoms or molecules inside an amorphous material (Meyers and Chawla (1999): "Mechanical Behavior of Materials," 98-103). Viscoelastic materials are typically considered to have memory, or "hysteresis"; that is, the effects of the current input to the system are not felt at the same instant (Mielke, A.; Roubieek, T. (2003). "A Rate-Independent Model for Inelastic Behavior of Shape-Memory Alloys", *Multiscale Model. Simul.* (4): 571-597). It is preferred that the viscoelastic materials used to produce the washers described herein combine the properties of shock absorption, memory, vibration isolation, and vibration damping. Suitable viscoelastic materials also exhibit a high damping coefficient (e.g., a material property that indicates whether a material will "bounce back" or return energy to a system; also known as recovery time, tangent of delta, tan delta, loss factor), functionality at a wide range of temperatures (e.g., anywhere from −20° to +160° Fahrenheit (−29° to 72° Celsius)), a very low creep rate, a long fatigue life (e.g., through 100, 1000, $10^4$, $10^5$, $10^6$ or more cycles). It is preferred that the viscoelastic material be capable of absorbing at least about 50, 60, 70, 80, 90, or 95% of the energy (e.g., the "shock energy" resulting from contact between the cymbal with a drumstick and/or cymbal mounting assembly). The viscoelastic materials may have a recovery time known to be acceptable in the art (e.g., about 10-100 milliseconds for a 3/16 inch thick material after application of a practical load (e.g., 180 lbs) for about 400 milliseconds, as described in U.S. Pat. No. 4,476,258). The viscoelastic material must also be of a sufficient hardness, or durometer, such that the shock energy is sufficiently absorbed thereby, and therefore efficiently directed away from the cymbal. Other parameters of suitable viscoelastic materials are known to those of skill in the art, and may be applicable.

Test methods used to determine the various characteristics of the viscoelastic materials include, for example, ASTM 395 (Method B), ASTM 0412 92, ASTM D2240 (or the analogous ISO test method ISO 868), ASTM D575 91, ASTM D624 91 Die C, ASTM D1894 on polished steel, ASTM 0792, and ASTM E1640 94 by peak Tangent Delta, among others. Each of these testing procedures are well-known and widely available to those of skill in the art. For example, regarding durometer, twelve durometer scales are typically referenced (e.g., types A, B, C, D, DO, E, M, O, OO, OOO, OOO—S, and R) using standard testing. Each scale results in a value between 0 and 100, with higher values indicating a harder material. A suitable durometer may be selected by one of skill in the art using standard techniques (e.g., using the tests described, herein and/or by observing the effect of viscoelastic washers of varying durometer on cymbal breakage when used in the cymbal assemblies described herein). The viscoelastic washers described herein may typically be of a durometer of, for example, about 20, 25, 30, 35, 40, 45, 50, 55, 60, 65, 70, 75, and 80 using ASTM D2240 (scale 00) testing. Particularly useful durometers for use in the viscoelastic washers described herein may be about 30, 35, 37, 42, 50, and or 70 (ASTM D2240, scale 00). As described below, viscoelastic washers may also contain combinations of layers of varying durometer (e.g., a layer of lower durometer (e.g., 35) material adjoined to a layer of higher durometer (e.g., 50) material). Materials having one or more of the aforementioned properties may be selected and used to prepare the viscoelastic washers described herein.

Exemplary suitable viscoelastic materials may include those described in, for example, U.S. Pat. Nos. 4,101,704 (Hiles, M., issued Jul. 18, 1978); 4,346,205 Wiles, M., issued Aug. 24, 1982); 4,476,258 (Hiles, M., issued Oct. 9, 1984); and, 4,808,469 (Hiles, M., issued Feb. 28, 1989). A suitable viscoelastic material may be, for example, a polyurethane composition described by U.S. Pat. No. 4,808,469, having, for example, a density of from about 0.4 to about 1 glee, a compression set of less than about 5% (measured using ASTM standard test 395, Method B) and a recovery time of from about 10 to about 100 milliseconds. This material may be prepared following, for example, as is known in the art, having: been fully described in Example IV of U.S. Pat. No. 4,808,469.

A particularly suitable viscoelastic material may be the material produced under the trademark Sorbothane® (available from Sorbothane, Inc. (Kent, Ohio); www.sorbothane.com, viewed Aug. 18, 2008). Sorbothane® is a proprietary polyol isocyanate based composition understood by those of skill in the art to contain about a 1:10 (by weight) mixture of isocyanate and polyol, giving it quasi-fluid qualities. Its density is about 80 lb/cubic foot. The durometer of Sorbothane® is typically measured by the softest durometer scale available ("Shore 00") using ASTM D2240 testing. Low durometer (e.g., 30) Sorbothane creeps about 8% under load and then stabilizes. High durometer (e.g., 70) Sorbothane creeps about 5% under load and then stabilizes. The optimum performance temperature of Sorbothane (durometers 30, 50, 70) is about −20° C. to 160° F., Sorbothane® (durometers 30, 50, 70) is typically; 1) resistant to bacterial and fungal growth, as well as UV light; 2) chemically resistant to hydraulic fluid (−1.4% weight change), kerosene (4.3% weight change), diesel (6.4% weight change), and soap solution (5% weight change), each as measured using test ASTM D543 (7-day immersion); 3) stable in standard heat aging tests; exhibits a kinetic coefficient of friction of about 3 (as measured by ASTM D1894 on polished steel); 4) of a density of about 85 lb/ft$^2$ (as measured by ASTM D792); and, 5) of a specific gravity of about 1.4 (as measured by ASTM D792). Exemplary additional identifying characteristics of Sorbothane® are summarized below:

TABLE 1

| Property (unit of measurement) | Durometer* 30 | 50 | 70 | Test |
|---|---|---|---|---|
| Tensile strength at break (psi) | 83 | 123 | 205 | ASTM D412 92 |
| Elongation at break (%) | 580 | 570 | 400 | ASTM D412 92 |
| Tensile elastic strength at 100% strain (psi) | 18 | 25 | 66 | ASTM D412 92 |
| Tensile elastic strength at 200% strain (psi) | 36 | 55 | 127 | ASTM D412 92 |
| Tensile elastic strength at 300% strain (psi) | 55 | 80 | 166 | ASTM D412 92 |
| Compressive stress at 20% strain (psi) | 6 | 12 | 30 | ASTM D575 91 |
| Compressive stress 50% strain (psi) | 86 | 105 | 232 | ASTM D575 91 |
| Tear strength (lb/inch) | 44 | 49 | 65 | ASTM D624 91 Die C |
| Static coefficient of friction | 16 | 10 | 4 | ASTM D1894 on polished steel |
| Glass transition (Celsius) | 38.7 | 37.4 | 34.7 | ASTM E1640 94 by Tangent Delta |
| Resilience test rebound height (%) | 2 | 11 | 22 | ASTM D2632 92 |
| Resilience test rebound height (%) | 16 | 18 | 25 | ASTM D2632 92 modified for the effects of material tack |
| Dielectric strength (V/mil) | 241 | 256 | 261 | ASTM D149 97 |
| Dynamic Young's Modulus at 5 hertz (psi) | 90 | 105 | 120 | |
| Dynamic Young's Modulus at 15 hertz (psi) | 135 | 150 | 162 | |

TABLE 1-continued

| Property (unit of measurement) | Durometer* 30 | 50 | 70 | Test |
|---|---|---|---|---|
| Dynamic Young's Modulus at 30 hertz (psi) | 190 | 210 | 240 | |
| Dynamic Young's Modulus at 50 hertz (psi) | 250 | 270 | 300 | |
| Tangent Delta at 5 Hertz excitation | 0.30 | 0.56 | 0.56 | |
| Tangent Delta at 15 Hertz excitation | 0.38 | 0.58 | 0.60 | |
| Tangent Delta at 30 Hertz excitation | 0.45 | 0.57 | 0.59 | |
| Tangent Delta at 50 Hertz excitation | 0.35 | 0.50 | 0.55 | |

*All values are approximate and may typically vary about 5-10% between individual tests.

As should be evident to one of skill in the art, the viscoelastic material used herein is not a conventional naturally-occurring or synthetic rubber (also commonly referred to as an elastic polymer), whether vulcanized or not. As a commercial product (e.g., synthetic rubber), rubber is typically derived from natural rubber latex (e.g., gum rubber) and may be isolated from plants, including but not limited to *Hevea brasilienses, Palaquium gutta, Ficus elastica, Castilla elastica, Euphorbia* spp., lettuce, *Taraxacum officinale, Taraxacum kok-saghyz, Scorzonera* (*tau-saghyz*), and *Parthenium argentatum*, or similar sources. While conventional rubber is considered to have hyperelastic properties, it is not understood to exhibit the resilient properties provided of a viscoelastic material, as described herein. As such, the viscoelastic washers described herein typically do not contain conventional rubber. However, in certain embodiments, washers may be produced that contain conventional rubber. For instance, the washers may partially consist of conventional rubber (e.g., about 5, 10, 15, 20, 25, 30, 35, 40, 45, 50% or more, conventional naturally-occurring or synthetic rubber) to provide a combined viscoelastic/rubber combination material. Certain rubber-like materials may also be used, either alone or in combination with the viscoelastic materials described herein (e.g., as described in U.S. Pat. Nos. 4,346,205; 4,476,258; 4,504,604; 4,808,469; polyether materials such as those sold under "Mondur" trade name (e.g., from Bayer Materials Science)), and/or conventional rubber, to produce washers of combination materials of viscoelastic, conventional rubber, and/or rubber-like materials. The cymbal assemblies described herein may also include rubber or rubber-like washers along with the viscoelastic washers described herein.

The use of viscoelastic washers (e.g., made of Sorbothane®) has been surprisingly found to dramatically reduce cymbal breakage when utilized as part of a cymbal mounting assembly, as described herein. The cymbal mounting assemblies described herein include multiple components that together provide secure attachment of a cymbal to the cymbal mounting assembly and maintain excellent sound quality therefrom. In one embodiment, the cymbal mounting, assembly (e.g., FIG. 5) includes a cymbal stand shaft, an optional "sleeve" made of a shock absorbing material (e.g., plastic, rubber, paper, gel, or the like) around at least a portion of the shaft, one or more support washers (e.g., base support washer or upper washer) made of a substantially solid material (e.g. aluminum, steel, hard plastic, or the like), one or more flexible washers made of a flexible material (e.g., plastic, rubber, paper, gel, felt, or the like), one or more washers made of a viscoelastic material (e.g. Sarbothane®), and a device for fastening the cymbal mounting assembly and cymbal to one another (e.g., "fastening device" such as a wing nut or the like). In certain embodiments, the cymbal mounting assembly may include some or all of the above-described components. For example, the cymbal mounting: assembly may comprise one or more support washers and one or more washers made of a viscoelastic material. The cymbal mounting assembly may also comprise only one or more washers made of a viscoelastic material, which may be the same or different (e.g., in material or character (e.g., durometer)). Other combinations of elements known to those of skill in the art may also be incorporated, into the cymbal mounting assembly.

In one embodiment, the cymbal mounting assembly may comprise one or more of a cymbal stand shaft., a sleeve made of a shock absorbing material (e.g., plastic, rubber, paper, gel, or the like) around the shaft, a base support washer, one or more felt pads or felt washers, at least one or more washers made of a viscoelastic material, an upper washer, and a device for fastening the cymbal mounting assembly and cymbal to one another (e.g., a wing, nut). An exemplary cymbal mounting assembly in shown in FIG. 5. As shown therein, the cymbal mounting assembly may also comprise a cymbal. In another embodiment, the cymbal mounting assembly may comprise an upper and/or a lower Washer assembly. The upper and lower washer assembly or assemblies may comprise one or more support washers (e.g., base support washer, upper washer) made of a substantially solid material (e.g., aluminum, steel, hard plastic, or the like), one or more flexible washers made of a flexible material (e.g., plastic, rubber, paper, gel, felt. Or the like), and one or more viscoelastic washers. In certain embodiments, the one or more flexible washers may be positioned between the one or more support washers and the viscoelastic washer. Another one or more flexible washers may also be positioned between the viscoelastic or elastopolymeric washer and the cymbal. Certain embodiments may include one or more flexible washers positioned either between the support washer and the viscoelastic washer, and/or between the viscoelastic washer and the cymbal.

Other embodiments comprise a limited selection of one or more of these components, such as the flexible washer(s). In some embodiments, the viscoelastic washer may consist of more than one viscoelastic or other material (e.g., using an aforementioned combination material or including composite parts arranged as layers). For example, a viscoelastic material of a particular strength or character (e.g., having a particular durometer such as but not limited to 35) may be adjoined to a top and/or bottom layer of material having a different strength or differing in another property (e.g., ability to adhere to other materials or "stickiness", higher or lower durometer). To prepare such a washer, a mold may be initially injected with a thin layer of a first type of material (e.g., a "high durometer" (e.g., 70) Sorbothane®) followed by a layer of a second type of material (e.g., a lower durometer Sorbothane® (e.g., 35)), followed by another thin layer of the first or another type of material, in either case different from the second type of material, (e.g., a high durometer (e.g., 70) Sorbothane®) to complete the part. As such, the second type of material (e.g., the lower durometer Sorbothane®) is sandwiched by two layers consisting of different types of material (e.g., the higher durometer Sorbothane®). A single layer of each material, or multiple alternating layers of each type of materials, may also be used. Variations of such arrangements of materials are also contemplated, as would be understood by one of skill in the art.

It may also be important to protect the viscoelastic washer from the effects of friction between the cymbal and this support arrangement. Direct contact between the cymbal and washer may lead to disintegration (e.g., chafing) of the viscoelastic material. Therefore, in certain embodiments, a friction buffering system may be utilized. The friction buffering system may comprise a protective layer or coating made of any suitable material such as, for example, felt, paper, rubber, powder, gel, or the like. Preferred buffering layers include, for example, one or more felt pads or washers (e.g., FIG. 5). In addition to or in the alternative, the viscoelastic washer may be coated with a material that decreases tackiness and/or provides a "non-stick" characteristic thereto (e.g., a non-stick coating). "Non-stick" means that the coating decreases the ability of the viscoelastic washer to adhere to another material, such as a flexible washer or cymbal, as compared an uncoated viscoelastic washer. The non-stick coating preferably allows the other material (e.g., flexible washer, cymbal) to release from the viscoelastic washer more easily (as compared to uncoated viscoelastic washers) while maintaining its capacity to act, as a shock absorber, in certain embodiments, one or more viscoelastic or elastopolymeric washers coated as described above may be used without any additional materials (e.g., flexible washers, felt pads, felt washers, or plastic sleeves) for improving the interface between the viscoelastic washer and the cymbal, base support washer, cymbal stand shaft, and or upper washer, for instance. In other embodiments, the coated viscoelastic washers may be used with such additional materials (e.g., flexible washers, felt pads, felt washers, or plastic sleeves).

Certain viscoelastic materials are known to exhibit "stickiness" or tack (e.g., "material tack") which one may desire to reduce or eliminate (e.g., the viscoelastic material may stick to components of the cymbal mounting assembly). As such, additional materials may be used to coat the viscoelastic washers to provide or improve the "non-stick" characteristics (e.g., lower the stickiness or tack) thereof. For instance, the viscoelastic washer may be coated with a polyurethane substance, a Teflon® material (e.g., polytetrafluoroethylene), or a powder such as talcum powder. The surface of the viscoelastic material may also be treated with a composition such as a chlorine-water mix (and typically washed after treatment). The washers each typically comprise an upper and a lower exterior surface as well as an exterior surface within the centrally positioned orifice (e.g., hole) through which the cymbal stand shall is inserted. The coating may be applied to one or more of these exterior surfaces, or to all of the exterior surfaces. The coating may be applied using standard manufacturing techniques.

The viscoelastic washer may be adjoined to other materials using standard techniques. For instance, the viscoelastic washer may be attached to another material (e.g., a flexible material such as a felt washer) by affixing (typically) similarly sized materials together using a conventional adhesive (e.g., Loctite® 4851 or 4861). Materials of different sizes may also be used. The materials may also be joined within a mold (e.g., molded as a single piece) by placing the other material into the mold, and subsequently injecting the viscoelastic material into the mold. The different materials may also be simply arranged within the cymbal mounting assembly such that one is adjacent to the other, as described below, without the use of a formal adjoining process (e.g., without adhesive or pre-molding). Other techniques for adjoining such materials available to those of skill in the art may also be utilized.

Figure 5:
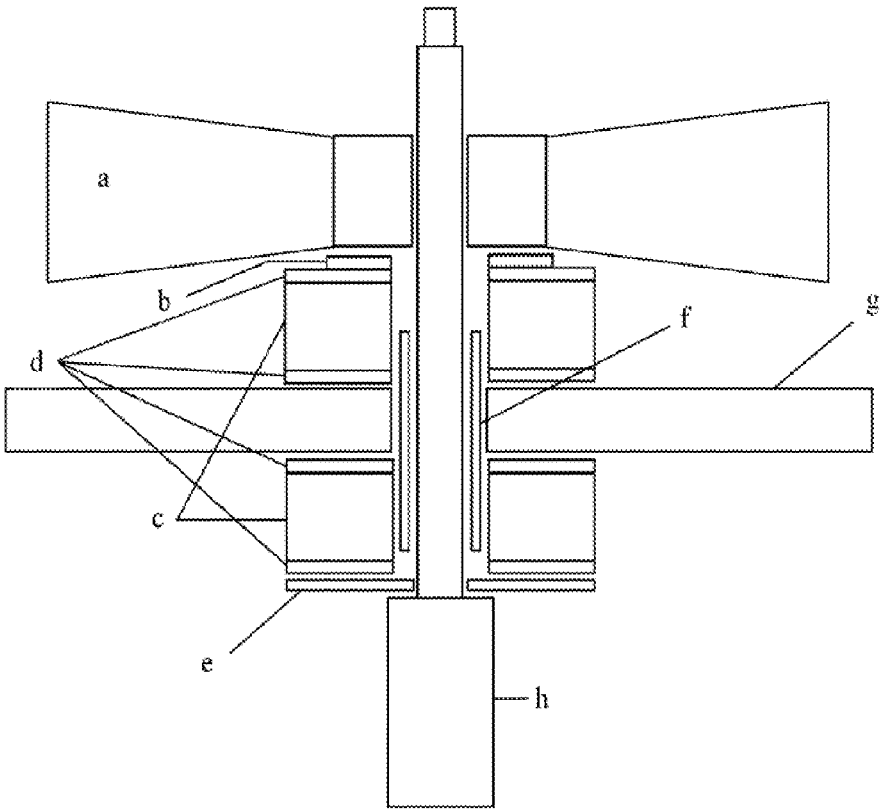
FIG. 5 illustrates an exemplary improved, cymbal mounting assembly described herein.

The components of the cymbal mounting assembly described herein may be arranged in any of the following exemplary, non-limiting arrangements, all typically: 1) built upon a support such as a cymbal stand shall with an optional "sleeve" made of a shock absorbing material (e.g., plastic, rubber, paper, gel, or the like), and 2) including a fastening device. In addition to these components, the cymbal mounting assembly typically includes at least one upper and/or lower washer assembly (e.g., essentially as shown in FIG. 5). The components of the upper and lower washer assemblies may be oriented in any of the following exemplary, non-limiting arrangements:

1) upper washer assembly;

a. upper support washer, flexible material, viscoelastic washer, flexible material;

b. upper support washer, flexible material, viscoelastic washer;

c. upper support washer, viscoelastic washer, flexible material:

d. upper support washer, viscoelastic washer;

e. flexible material, viscoelastic washer, flexible material;

f. flexible material, viscoelastic washer;

g. viscoelastic washer, flexible material;

h. viscoelastic washer;

the components of each of groups a-h of the upper washer assembly being listed from top to bottom relative to the upper surface or the cymbal, 2) lower washer assembly:

a. flexible material, viscoelastic washer, flexible material, base support washer;

b. flexible material, viscoelastic washer, base support washer;

c. viscoelastic washer, flexible material, base support washer;

d. flexible material, viscoelastic washer, flexible material;

e. flexible material, viscoelastic washer;

f. viscoelastic washer, flexible material;

g. viscoelastic washer, base support washer; and, h. viscoelastic washer.

the components of each of groups a-h of the lower washer assembly being listed from top to bottom relative to the lower surface of the cymbal.

As described above, multiple viscoelastic washers may also be used in each of the upper and lower assemblies. In such arrangements, one of the viscoelastic washers may be of a particular type (e.g., higher or lower durometer), and the other of another type (e.g., higher or lower durometer). One or more of each of the components listed above may be included in a cymbal mounting assembly. For instance, in some embodiments, multiple flexible materials may be included (e.g., a rubber washer and a felt pad) along with the viscoelastic washer(s). In such cases, using the rubber washer and felt pad as an exemplary combination of flexible materials, the rubber washer may be between the felt pad and the support washer, or may be between the felt pad and the support washer, for instance. A rubber washer may also be used with a viscoelastic washer without an additional flexible materials (e.g., felt pad). The support washers (e.g., upper and base support washers) may not be needed where, for instance, the support functions are incorporated into the cymbal stand (e.g., as part of the cymbal stand structure). In such cases, the various components may simply be supported by or rest upon that structure without the need for additional support that would be provided by a support washer (although a support washer may still be utilized). One or both of the upper and/or lower washer assemblies may be utilized in a particular cymbal mounting assembly. Multiple of either of the upper and/or lower washer assemblies may also be utilized in a particular cymbal mounting assembly. Variations or such arrangements are also contemplated, as would be understood by one of skill in the art. All embodiments, however, include one or more viscoelastic washers.

A kit for mounting a cymbal to a cymbal stand is also provided. In certain embodiments, the kit includes a viscoelastic washer and directions for use thereof. The kit may also include at least one flexible material, such as one or more felt washers for use with the viscoelastic washer. Where different or additional components are to be supplied in the kit (e.g., to provide the upper and lower washer assemblies described herein), the list of components included in the kit will vary accordingly. Other variations of kits would also be understood by those of skill in the art.

All ranges described, herein are to be understood to include each value with that range as if each of such values is individually listed herein. The use a the term "about" immediately preceding a list of values is meant to apply the term each individual value in the list, as if the term had been included immediately preceding each individual value. All documents cited within this disclosure are hereby incorporated by reference in their entirety. Certain embodiments are further described in the following examples. These embodiments are provided, as examples only and are not intended to limit the scope of the claims in any way.

EXAMPLES

In one embodiment, the cymbal mounting assembly includes upper and lower washer assemblies that each include at least one viscoelastic washer (Sorbothane®, durometer 30) sandwiched between two pieces of flexible material (e.g., felt) of approximately the same size as the washer. The viscoelastic material was prepared in a circular shape (about 35 mm diameter) with a centrally-placed circular orifice (about 5 mm diameter) placed therein using standard molding techniques. Exemplary assemblies were arranged essentially as shown in FIG. 5 and as follows:

Upper washer assembly: upper support washer, flexible material, viscoelastic washer, flexible material; and, Lower washer assembly: flexible material, viscoelastic washer, flexible material, base support washer.

The upper and lower washer assemblies were assembled upon a cymbal stand shaft including a plastic sleeve preventing direct contact between the upper washer assembly, the cymbal, and the lower washer assembly with the shaft. The components were affixed to the cymbal stand using a wing nut over the upper washer assembly.

The cymbal mounting assembly described above was used in a professional musical performances. The ability of the cymbal assemblies including the viscoelastic washers to prevent cymbal breakage were compared to assemblies including only standard felt washers. There was no discernable difference in tone or sustain. During a four-week tour of heavy playing with the viscoelastic washers, no breakages occurred. Following that, another low week tour with the same cymbals played in the same manner but using standard felt washers, seven cymbals were broken with edge fractures. Thus, the use of viscoelastic washers made of Sorbothane® in cymbal mounting assemblies were found to provide surprisingly superior protection against breakage when compared to currently available cymbal mounting assemblies.

While this disclosure provides a description in terms of the preferred embodiments, it is understood that variations and modifications will occur to those skilled in the art. Therefore, it is intended that the appended claims cover all such equivalent variations that come within the scope of this disclosure.

What is claimed is:

1. A cymbal assembly comprising at least one viscoelastic washer consisting essentially of a polyol isocyanate composition containing about a 1:10 by weight mixture of isocyanate and polyol.

2. The cymbal assembly of claim 1 wherein the viscoelastic washer has a durometer of between 30 and 70 as determined by test ASTM D2240 (scale 00).

3. The cymbal assembly of claim 1 wherein the viscoelastic washer has a durometer selected from the group consisting of 20, 25, 30, 35, 37, 40, 42, 45, 50, 55, 60, 65, 70, 75, and 80 as determined by test ASTM D2240 (scale 00).

4. The cymbal assembly of claim 1 wherein the viscoelastic washer has a durometer of about 30 as determined by test ASTM D2240 (scale 00).

5. The cymbal assembly of claim 1 wherein the viscoelastic washer has a durometer of about 35 as determined by test ASTM D2240 (scale 00).

6. The cymbal mounting assembly of claim 1, the assembly comprising an upper washer assembly and a lower washer assembly, wherein the upper and lower washer assemblies each comprise a viscoelastic washer and at least one of a support washer and a flexible material.

7. A cymbal mounting assembly of claim 1 attached to a cymbal having an upper and lower surface, the cymbal mounting assembly comprising an upper washer assembly positioned above the upper surface of the cymbal and a lower washer assembly positioned below the lower surface cymbal, the upper washer assembly comprising a group of components selected from the group consisting of:

a. upper support washer, flexible material, viscoelastic washer, flexible material;
b. upper support washer, flexible material, viscoelastic washer;
c. upper support washer, viscoelastic washer, flexible material;
d. upper support washer, viscoelastic washer;
e. flexible material, viscoelastic washer, flexible material;
f. flexible material, viscoelastic washer;
g. viscoelastic washer, flexible material;
h. viscoelastic washer; and, the components of each of groups a-h of the upper washer assembly being listed from top to bottom relative to the upper surface of the cymbal, the lower washer assembly comprising a group of components selected from the group consisting of:

a. flexible material, viscoelastic washer, flexible material, base support washer;
b. flexible material, viscoelastic washer, base support washer;
c. viscoelastic washer, flexible material, base support washer;
d. flexible material, viscoelastic washer, flexible material;
e. flexible material, viscoelastic washer;
f. viscoelastic washer, flexible material;
g. viscoelastic washer, base support washer; and,
h. viscoelastic washer, the components of each of groups a-h of the lower washer assembly being listed from top to bottom relative to the lower surface of the cymbal.

8. The cymbal assembly of claim 1, further comprising a cymbal stand shaft, a sleeve comprised of shock absorbing material secured to the cymbal stand shaft, one or more substantially solid washers for supporting the at least one viscoelastic washer, one or more flexible washers in contact with the at least one viscoelastic washers.

9. The cymbal assembly of claim 8 wherein the shock absorbing material is selected from the group consisting of plastic, rubber, paper, and gel.

10. The cymbal assembly of claim 8 wherein the flexible washer comprises a flexible material selected from the group consisting of plastic, rubber, paper, gel, cloth, and felt.

11. The cymbal assembly of any one of claims 1-10 wherein the viscoelastic washer comprises at least one surface has been modified to reduce material tack.

12. The cymbal assembly of claim 11 wherein surface was modified using a material selected from the group consisting of polyurethane, polytetrafluoroethylene, powder, and talcum powder.

13. The cymbal assembly of any one of claims 1-12 wherein the viscoelastic washer comprises at least a first and a second viscoelastic material, wherein the first viscoelastic material forms a layer which is adjoined to one or more layers comprising the second viscoelastic material.

14. The cymbal assembly of claim 7 wherein the first and second viscoelastic materials exhibit different durometers.

15. A washer for use in a cymbal assembly, the washer comprising a viscoelastic material consisting essentially of a polyol isocyanate composition containing about a 1:10 (by weight) mixture of isocyanate and polyol.

16. A kit for mounting a cymbal to a cymbal stand, the kit comprising a viscoelastic washer consisting essentially of a polyol isocyanate composition containing about a 1:10 (by weight) mixture of isocyanate and polyol and directions for use thereof.

17. The kit of claim 16 further comprising at least one flexible material.

18. The kit of claim 17 wherein the flexible material is a washer.

19. The kit of claim 18 wherein the flexible material is felt.

* * * * *